US010808346B1

(12) United States Patent
Buck

(10) Patent No.: US 10,808,346 B1
(45) Date of Patent: Oct. 20, 2020

(54) ROTARY HOOK SLEEVE

(71) Applicant: James Buck, Benbrook, TX (US)

(72) Inventor: James Buck, Benbrook, TX (US)

( * ) Notice: Subject to any disclaimer, the term of this patent is extended or adjusted under 35 U.S.C. 154(b) by 0 days.

(21) Appl. No.: 15/482,945

(22) Filed: Apr. 10, 2017

(51) Int. Cl.
*D05C 11/18* (2006.01)
*D05B 57/14* (2006.01)
*D05B 57/36* (2006.01)

(52) U.S. Cl.
CPC ..... *D05C 11/18* (2013.01); *D05B 57/14* (2013.01); *D05B 57/36* (2013.01)

(58) Field of Classification Search
CPC ..... D05C 11/18; D05B 57/10; D05B 75/14
See application file for complete search history.

(56) References Cited

U.S. PATENT DOCUMENTS 2,718,858 A * 9/1955 Ritter ..... D05B 57/14 112/181
3,063,392 A * 11/1962 Ketterer ..... D05B 63/00 112/181
3,698,333 A * 10/1972 Ketterer ..... D05B 57/14 112/189
3,943,866 A * 3/1976 Bogaert ..... D05B 57/14 112/228
3,955,520 A * 5/1976 Gebhardt ..... D05B 71/02 112/256
4,475,475 A * 10/1984 Zylbert ..... D05B 59/00 112/228
5,188,046 A * 2/1993 Badillo ..... D05B 57/265 112/231

* cited by examiner

*Primary Examiner* — Nathan E Durham
(74) *Attorney, Agent, or Firm* — Dickinson Wright, PLLC; Michael E. Noe, Jr.

(57) ABSTRACT

Embroidery and sewing machines can utilize rotary hooks to attach thread to materials. An adhesive joint configured to sever if the rotary hook becomes jammed prevents damage to the rest of the drive system. The severable joint is located between a sleeve and a drive shaft nearest the rotary hook to allow for easy removal and repair of the joint.

9 Claims, 4 Drawing Sheets

ROTARY HOOK SLEEVE

BACKGROUND

1. Field of the Invention

The present invention relates generally to sewing machines and embroidery machines with rotary hooks, and more specifically to a system and method for a rotary hook drive shaft having a release feature to improve the maintainability of embroidery machines and sewing machines having rotary hooks.

2. Description of Related Art

Rotary hooks are utilized on embroidery machines and sewing machines for hooking thread from the lower bobbin to the upper bobbin. Rotary hooks are conventionally driven by gearboxes, drive shafts, pulleys, drive belts, or some combination thereof. During those times where conventionally driven rotary hooks seize, the drive system will fail as a result of the rotary hook seizing. Normally, when a hook seizes, a gear, a drive belt, or a pulley will slip or break and take down the entire embroidery machine. This damage requires extensive and costly repairs. Usually, these types of repairs require specialized technicians who may not be readily available and/or must travel a great distance to reach the machine. Some machines utilize a specialized gear in a gearbox that fails first, however repairing that gear requires opening the gearbox. While there are many systems for rotary hooks well known in the art, considerable room for improvement remains.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
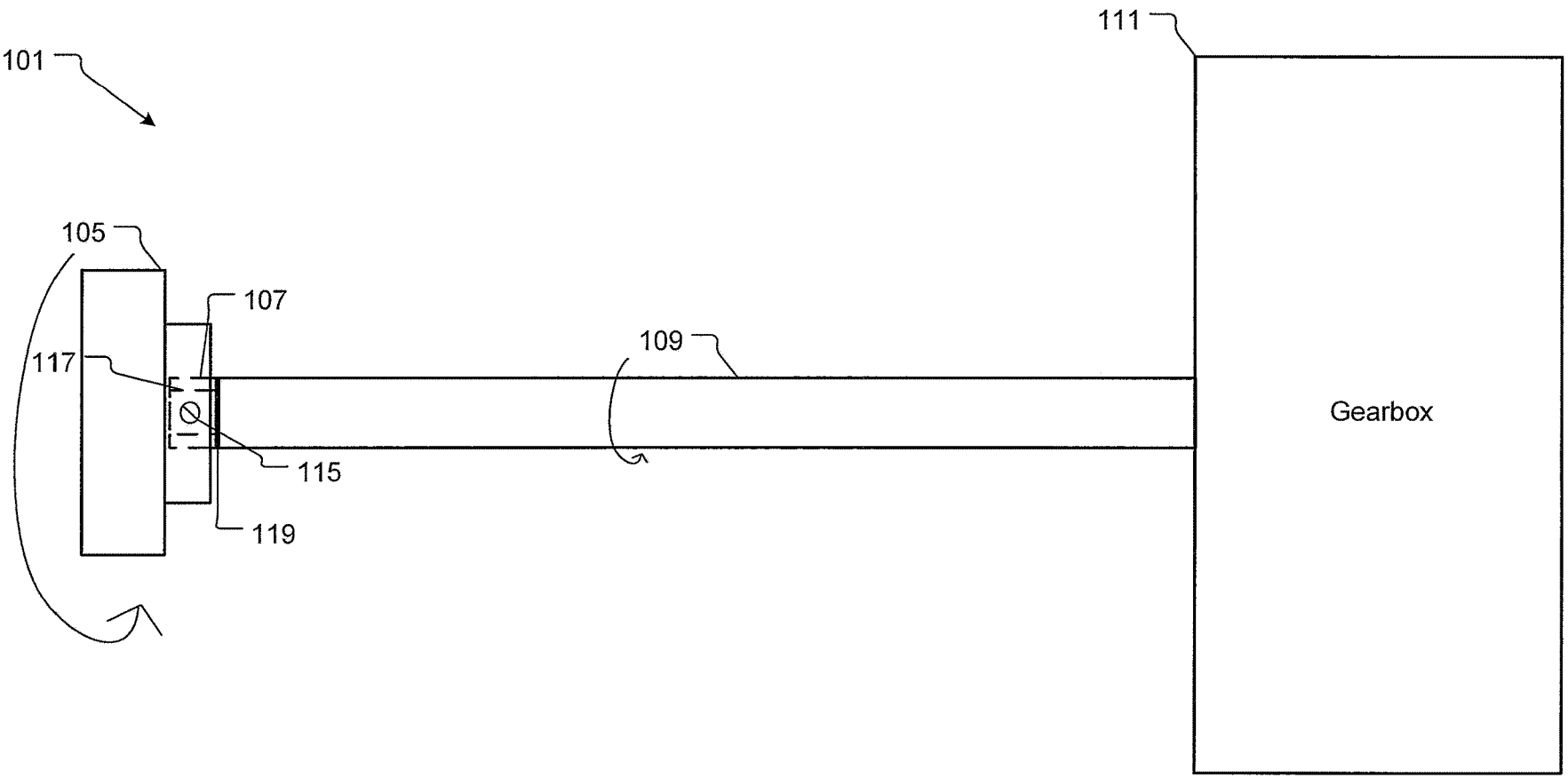
FIG. 1 is a top view of a rotary hook sleeve coupled illustrated according to the present application.

While the assembly of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the apparatus for a rotary hook shaft are provided below. It will of course be appreciated that in the development of any actual embodiment, numerous implementation-specific decisions will be made to achieve the developer's specific goals, such as compliance with assembly-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Embroidery and sewing machines can utilize rotary hooks to attach thread to materials such as hats and shirts. An adhesive sleeve selectively configured to slip or break free if the rotary hook becomes jammed prevents damage to the rest of the drive system and the entire machine. The sleeve is directly coupled to the rotary hook and glued to the drive shaft to allow for easy removal and repair of the failure.

Referring now to FIG. 1 in the drawings, a top view of an embroidery machine with a rotary hook sleeve illustrated according to the present application. System 101 is comprised of a rotary hook 105, a sleeve 107, a shaft 109, and a gearbox 111 driven by a motor (not shown). Preferably the shaft and the sleeve are fabricated from metal, however, they may be fabricated from polymers. To clearly show the improved structure, some elements were not illustrated such as a knife drive lever, a rotary hook base around the shaft 109, a pair of bushing or bearings between the shaft and the rotary hook box. Gearbox 111 rotationally drives the shaft 109. Shaft 109 is severable coupled to the sleeve 107. Rotary hook 105 is attached to the sleeve preferably with a set screw 115. Protruding out the sleeved end of shaft 109 is a shaft center 117. Typically the face of the shaft and the face of the sleeve are flat and true to receive the adhesive to fuse them together. Alternatively, the faces are textured to receive the adhesive.

Shaft 109 is preferably severably coupled to the sleeve 107 adhesively with an adhesive such 119 as Loctite™ or cyanoacrylate adhesive. While sleeve 107 is adhesively bonded to the shaft 109 and the shaft 109 spins, the sleeve 107 and the rotary hook 105 spins. However, if the rotary hook 105 stops spinning while the gearbox 111 continues to spin the shaft 109, the adhesive bond between the shaft and the sleeve will fail. Failure of adhesive 119 precludes damage to the rest of the drive train between the adhesive bond and the motor. Once the adhesive 119 has sheared, the user can restore the adhesive 119 by re-gluing the shaft to the sleeve. FIG. 1 illustrates the adhesive 119 spinning the sleeve while the shaft spins.

Figure 2:
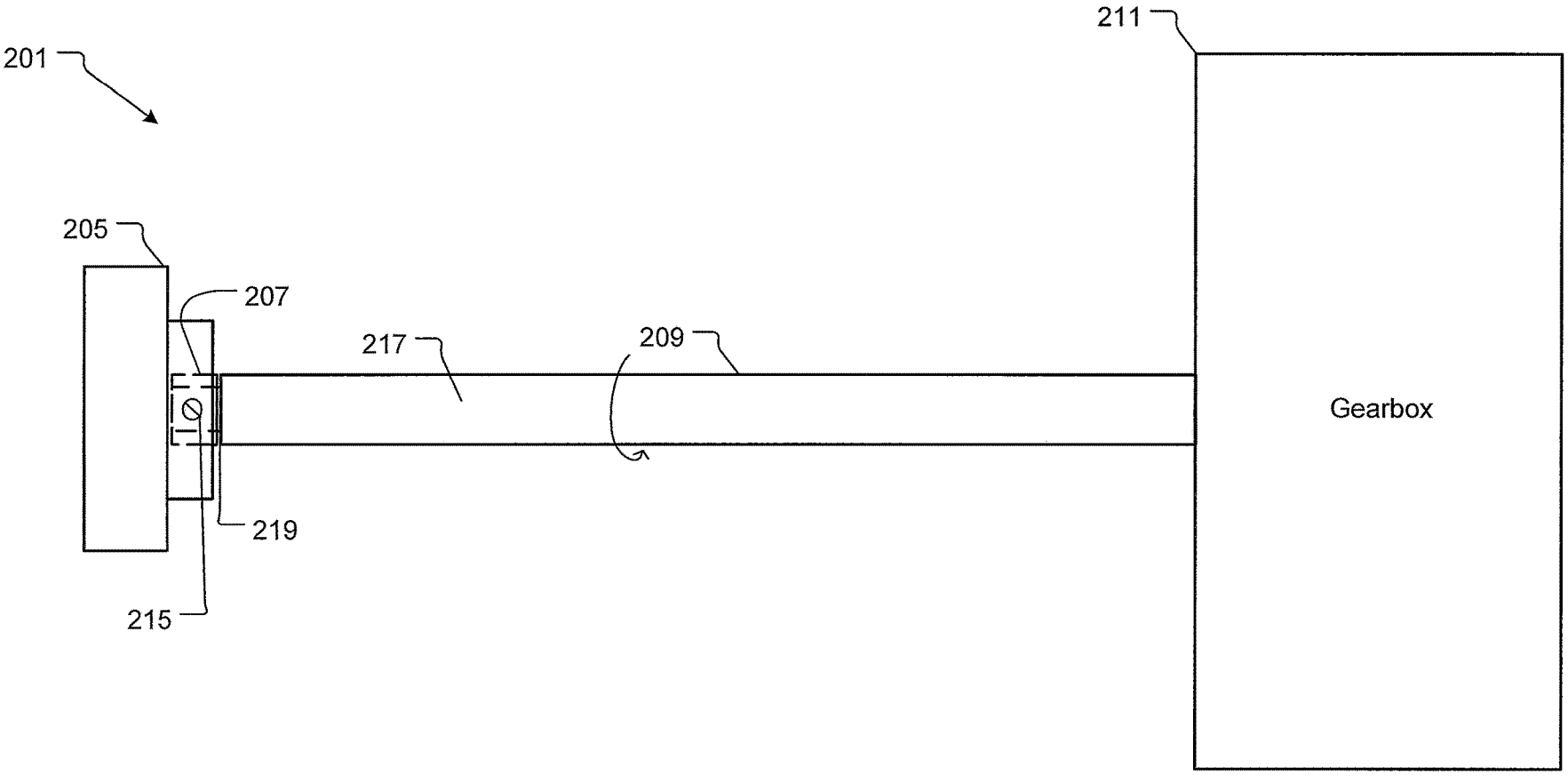
FIG. 2 is a top view of a rotary hook sleeve decoupled illustrated according to the present application.

Referring now also to FIG. 2 in the drawings, a top view of an embroidery machine with a rotary hook sleeve illustrated according to the present application. System 201 is comprised of a rotary hook 205, a sleeve 207, a shaft 209, and a gearbox 211 driven by a motor (not shown). To clearly show the improved structure, some elements were not illustrated such as a knife drive lever, a rotary hook base around the shaft 209, a pair of bushing or bearings between the shaft and the rotary hook box. Gearbox 211 rotationally drives the shaft 209. Shaft 209 is decoupled to the sleeve 207 and the sleeve rotates freely relative to the shaft. Rotary hook 205 is attached to the sleeve preferably with a set screw 215. Located in the center of the shaft 209 and protruding out the sleeved end is a shaft center 217. FIG. 2 illustrates a severed adhesive located between the sleeve and the shaft. Sleeve 207 utilizes an opening centered in the sleeve to receive the shaft center 217 of the shaft 209. Once the adhesive is severed the thread would break and alert the user based on feedback from the machine. The user could make the repair, by regluing the sleeve or merely not use one head of the embroidery machine until the repair is convenient to the user.

Figure 3:
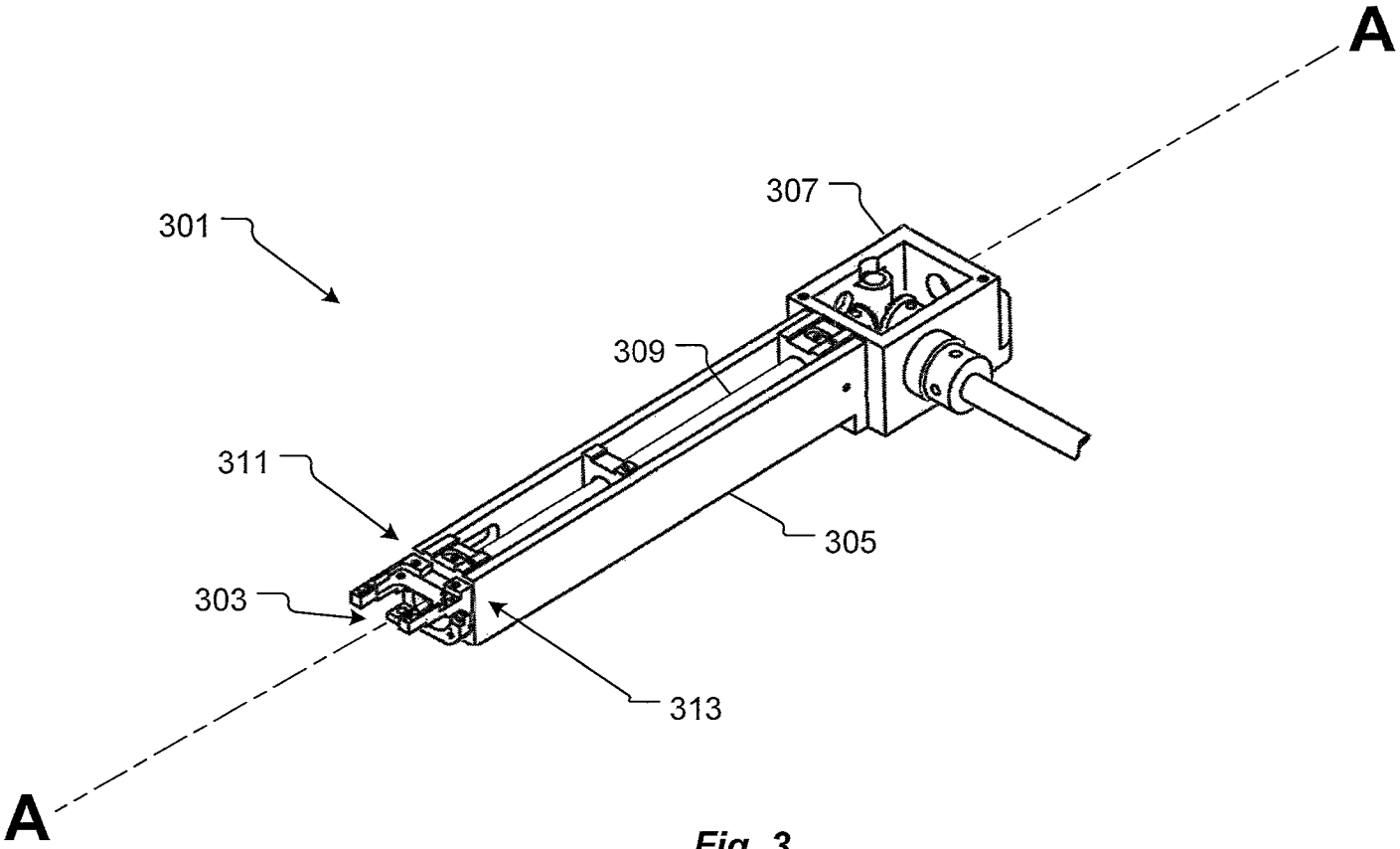
FIG. 3 is a perspective view of a rotary hook sleeve illustrated according to the present application.

Referring now to FIG. 3 in the drawings, a perspective view of an embroidery machine with a rotary hook sleeve illustrated according to the present application. System 301 is comprised of rotary hook 303 located at the front of a base 305, a gearbox 307, a shaft 309, and a sleeve 311. Sleeve 311 is rotationally coupled to the shaft 309 by adhesive 313 located between them. When the adhesive 313 fails, the sleeve 311 can be removed from the machine by sliding the sleeve 311 and rotary hook 393 out along axis A-A. Typically axis A-A is collinear with a rotational axis of the drive shaft. Additional adhesive can be applied to the interior end of sleeve and sleeve reinserted into the machine to recouple the sleeve to the shaft. Then the machine is rethreaded and the machine will sew once again. This method of repairing the sleeve interface does not require opening the embroidery machine and use of a specialized technician.

Figure 4:
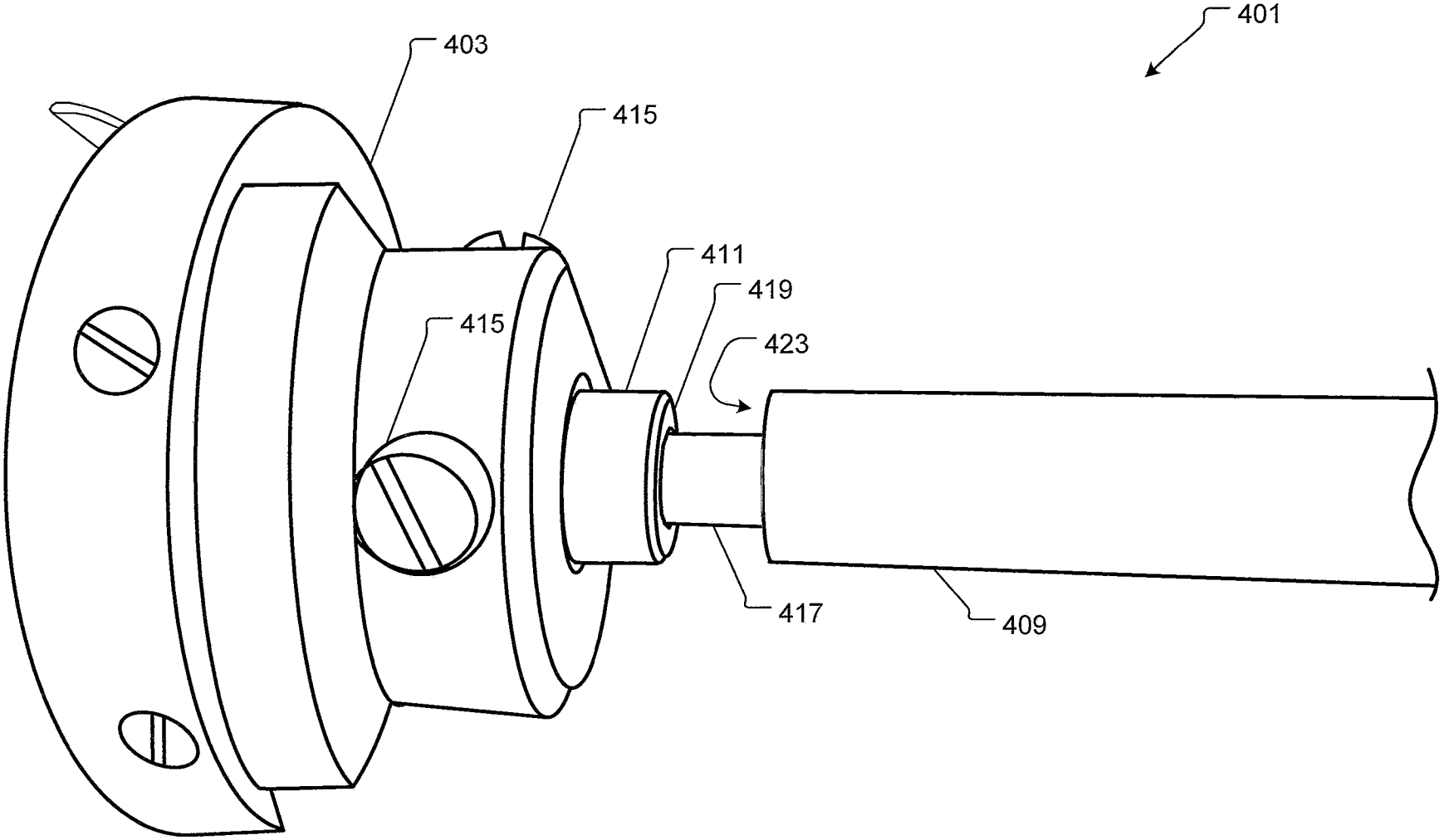
FIG. 4 is a perspective view of a rotary hook sleeve decoupled to a shaft illustrated according to the present application.

Referring now also to FIG. 4 in the drawings, a perspective view of a rotary hook sleeve decoupled illustrated according to the present application. System 401 is comprised of rotary hook 403, a shaft 409, and a sleeve 411. Rotary hook 403 is coupled to the sleeve 411 by set screws 415. Sleeve 411 is centered onto the shaft 409 by a center post 417 of the shaft 409. Preferably the center post 417 of the shaft 409 is integrally made together and they are formed from one piece of metallic stock. Alternatively, the post protrudes from the sleeve and into a centered opening of the shaft. Sleeve 411 is coupled to the shaft 409 by a layer of adhesive located on first surface 419 of the sleeve and first surface 423 of the shaft. Both the first surface 419 of the sleeve and the first surface 423 of the shaft are flat. FIG. 4 illustrates the sleeve translated a bit from the shaft. Typically during use, the first surface 419 of the sleeve is in contact with the first surface 423 of the shaft with a layer of adhesive located between. Therefore as the shaft spins, the sleeve also spins because they are glued together.

It is apparent that an assembly and method with significant advantages has been described and illustrated. The particular embodiments disclosed above are illustrative only, as the embodiments may be modified and practiced in different but equivalent manners apparent to those skilled in the art having the benefit of the teachings herein. It is, therefore, evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments but are amenable to various changes and modifications without departing from the spirit thereof.

What is claimed is:

1. A rotary hook system for an embroidery machine, comprising:

a gearbox coupled to a proximal end of a shaft having an axis, the shaft has a distal end with a shaft radial face that is transverse to the axis, and a shaft center extends axially beyond the shaft radial face;

a rotary hook mechanically coupled to a sleeve with a set screw, the sleeve comprises a receptacle in which the shaft center is located, the sleeve comprises a sleeve radial face on a proximal end thereof, and the sleeve radial face axially faces the shaft radial face; and an adhesive bonded to the shaft radial face and the sleeve radial face to couple the shaft to the rotary hook, such that rotation of the shaft rotates the rotary hook, and, when the rotary hook stops rotating while the gearbox rotates the shaft, the adhesive breaks between the shaft radial face and the sleeve radial face to decouple the shaft from the sleeve and the rotary hook to limit damage to the rotary hook system.

2. The system of claim 1, wherein the shaft radial face and the sleeve radial face are flat and true to receive the adhesive to fuse them together.

3. The system of claim 1, wherein both the shaft and the sleeve are metallic.

4. A rotary hook system for an embroidery machine, comprising:

a gearbox coupled to a proximal end of a shaft having an axis, the shaft has a distal end with a shaft radial face that is transverse to the axis;

a rotary hook mechanically coupled to a sleeve with a set screw, the sleeve comprises a sleeve radial face on a proximal end thereof, and the sleeve radial face axially faces the shaft radial face; and an adhesive bonded to the shaft radial face and the sleeve radial face to couple the shaft to the rotary hook, such that rotation of the shaft rotates the rotary hook, and, when the rotary hook stops rotating while the gearbox rotates the shaft, the adhesive breaks between the shaft radial face and the sleeve radial face to decouple the shaft from the sleeve and the rotary hook to limit damage to the rotary hook system.

5. The system of claim 4, wherein the sleeve is axially centered on the shaft by a center post of the shaft.

6. The system of claim 5, wherein the center post is integrally formed with the shaft from a single piece of metallic stock.

7. The system of claim 4, wherein a post protrudes from the sleeve and into a centered opening of the shaft.

8. The system of claim 4, wherein the shaft radial face and the sleeve radial face are flat and true to receive the adhesive to fuse them together.

9. The system of claim 4, wherein both the shaft and the sleeve are metallic.

* * * * *